US010944203B2

(12) United States Patent
Chang et al.

(10) Patent No.: US 10,944,203 B2
(45) Date of Patent: Mar. 9, 2021

(54) WATERPROOFING ELECTRICAL CONNECTOR

(71) Applicants: FU DING PRECISION INDUSTRIAL (ZHENGZHOU) CO.,LTD., Zhengzhou (CN); FOXCONN INTERCONNECT TECHNOLOGY LIMITED, Grand Cayman (KY)

(72) Inventors: Yen-Chih Chang, New Taipei (TW); Qin-Xin Cao, Kunshan (CN)

(73) Assignees: FU DING PRECISION INDUSTRIAL (ZHENGZHOU) CO., LTD., Zhengzhou (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/672,525

(22) Filed: Nov. 4, 2019

(65) Prior Publication Data

US 2020/0153153 A1 May 14, 2020

(30) Foreign Application Priority Data

Nov. 9, 2018 (CN) ..... 201821852130.8

(51) Int. Cl.
*H01R 13/40* (2006.01)
*H01R 13/52* (2006.01)
(Continued)

(52) U.S. Cl.
CPC ..... *H01R 13/5202* (2013.01); *H01R 12/707* (2013.01); *H01R 12/722* (2013.01); *H01R 24/58* (2013.01)

(58) Field of Classification Search
CPC ..... H01R 12/707; H01R 12/722; H01R 24/58
(Continued)

(56) References Cited

U.S. PATENT DOCUMENTS 7,198,504 B2 * 4/2007 Chien ..... G02B 6/4201 439/385
7,785,119 B1 * 8/2010 Chiang ..... H01R 13/7036 439/188
(Continued)

FOREIGN PATENT DOCUMENTS

CN 204144560 U 2/2015
CN 208797230 U 4/2019

*Primary Examiner* — Abdullah A Riyami
*Assistant Examiner* — Vladimir Imas
(74) *Attorney, Agent, or Firm* — Wei Te Chung; Ming Chieh Chang

(57) ABSTRACT

An electrical connector includes an insulative housing forming a mating cavity, a plurality of passageways located by two sides of the mating cavity, a bottom cover attached upon a bottom side of the housing to shield the mating cavity in a vertical direction. A plurality of contacts are disposed in the corresponding passageways, respectively. Each contact includes a retaining section retained in the corresponding passageway, a resilient contacting section extending from the retaining section and into the mating cavity, and a leg extending from the retaining section and downwardly through the bottom cover. A waterproofing glue plate is attached upon the bottom cover, and the legs of the contacts extend through the glue plate. The leg forms a transverse groove located in at least one surface and embedded within the glue plate so as to enhance securement between the glue plate and the leg.

20 Claims, 9 Drawing Sheets

(51) Int. Cl.
*H01R 12/70* (2011.01)
*H01R 24/58* (2011.01)
*H01R 12/72* (2011.01)

(58) Field of Classification Search
USPC ..... 439/587
See application file for complete search history.

(56) References Cited

U.S. PATENT DOCUMENTS

| | | | | |
|---|---|---|---|---|
| 8,388,380 | B1 * | 3/2013 | Van der Steen | H01R 13/5202 439/607.36 |
| 8,678,863 | B2 * | 3/2014 | Nagata | H01R 13/5213 439/606 |
| 8,808,035 | B2 * | 8/2014 | Wu | H01R 24/58 439/668 |
| 9,197,004 | B2 * | 11/2015 | Kuo | H01R 13/5202 |
| 9,225,105 | B2 * | 12/2015 | Cheong | H01R 13/5213 |
| 9,373,911 | B2 * | 6/2016 | Lo | H01R 13/5202 |
| 9,391,391 | B2 * | 7/2016 | Chien | H01R 13/5202 |
| 9,520,685 | B2 * | 12/2016 | Zhao | H01R 12/721 |
| 10,044,148 | B2 * | 8/2018 | Zhao | H01R 13/6581 |
| 10,211,574 | B2 * | 2/2019 | Zhao | H01R 13/506 |
| 10,411,389 | B2 * | 9/2019 | Zhao | H01R 13/405 |
| 10,483,700 | B2 * | 11/2019 | Chen | H01R 13/5219 |
| 2011/0195611 | A1 * | 8/2011 | Little | H01R 24/58 439/668 |
| 2013/0183867 | A1 * | 7/2013 | Wu | H01R 13/5202 439/668 |

* cited by examiner

WATERPROOFING ELECTRICAL CONNECTOR

BACKGROUND OF THE DISCLOSURE

1. Field of the Disclosure

The present disclosure relates to an electrical connector, and more particularly to an electrical connector equipped with a waterproofing glue plate through which either the contact leg or the shell leg extends.

2. Description of Related Arts

U.S. Pat. No. 9,564,722 discloses an electrical connector equipped with a combination of the waterproofing glue plate and glue frame upon the undersurface for sealing the gap between the contact leg and the housing. Anyhow, because of the heat expansion coefficient difference between the glue and the contact, the glue tends to be cracked away from the contact leg after the electrical connector is soldered upon the printed circuit board in a heated condition.

An improved electrical connector with the glue plate reliably secured to the contact leg or shell leg, is desired.

SUMMARY OF THE DISCLOSURE

An object of the invention is to provide an electrical connector with the reliable waterproofing function. The electrical connector includes an insulative housing forming a mating cavity, a plurality of passageways located by two sides of the mating cavity, a bottom cover attached upon a bottom side of the housing to shield the mating cavity in a vertical direction. A plurality of contacts are disposed in the corresponding passageways, respectively. Each contact includes a retaining section retained in the corresponding passageway, a resilient contacting section extending from the retaining section and into the mating cavity, and a leg extending from the retaining section and downwardly through the bottom cover. A waterproofing glue plate is attached upon the bottom cover, and the legs of the contacts extend through the glue plate. The leg forms a transverse groove located in at least one surface and embedded within the glue plate so as to enhance securement between the glue plate and the leg.

In other type connector, a metallic shield is attached upon the housing and further enclosed within an insulative outer cover. A glue plate is attached upon a rear side of the housing, and the legs of the shield extend through the glue plate. The leg forms a transverse groove in at least one surface for enhancing securement between the glue plate and the leg of the shield.

Other objects, advantages and novel features of the disclosure will become more apparent from the following detailed description when taken in conjunction with the accompanying drawings.

DETAILED DESCRIPTION OF THE PREFERRED EMBODIMENT

Figure 1:
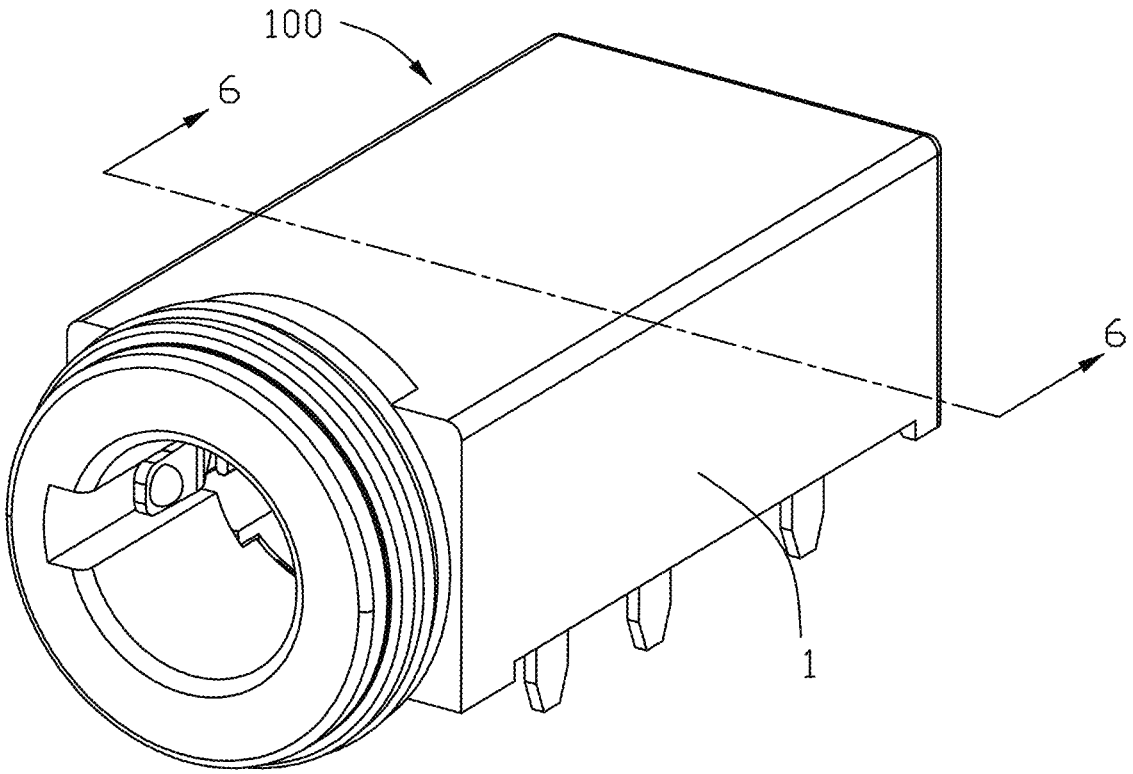
FIG. 1 is a perspective view of an electrical connector according to the invention.
Figure 2:
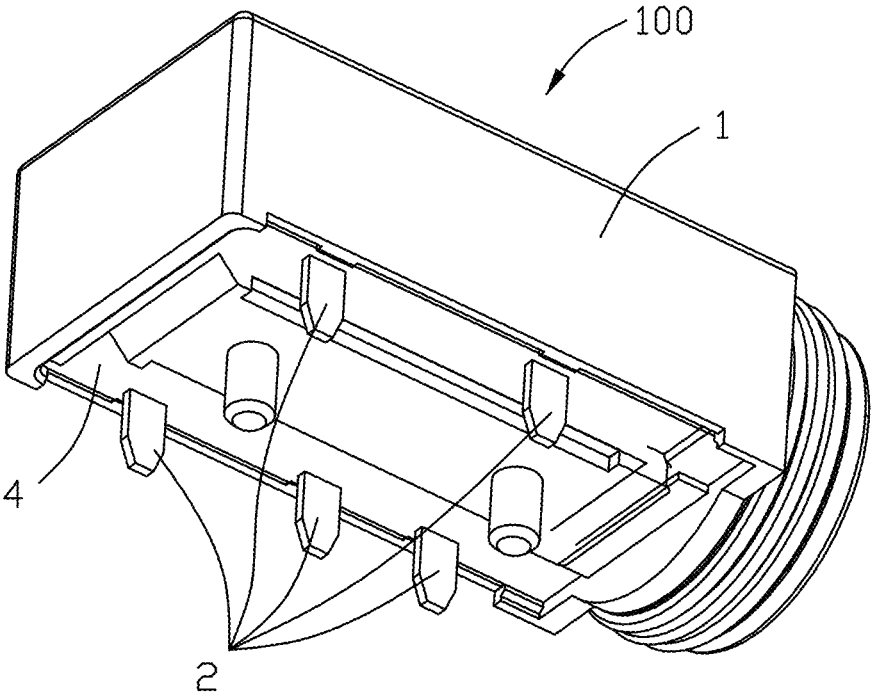
FIG. 2 is another perspective view of the electrical connector of FIG. 1.
Figure 3:
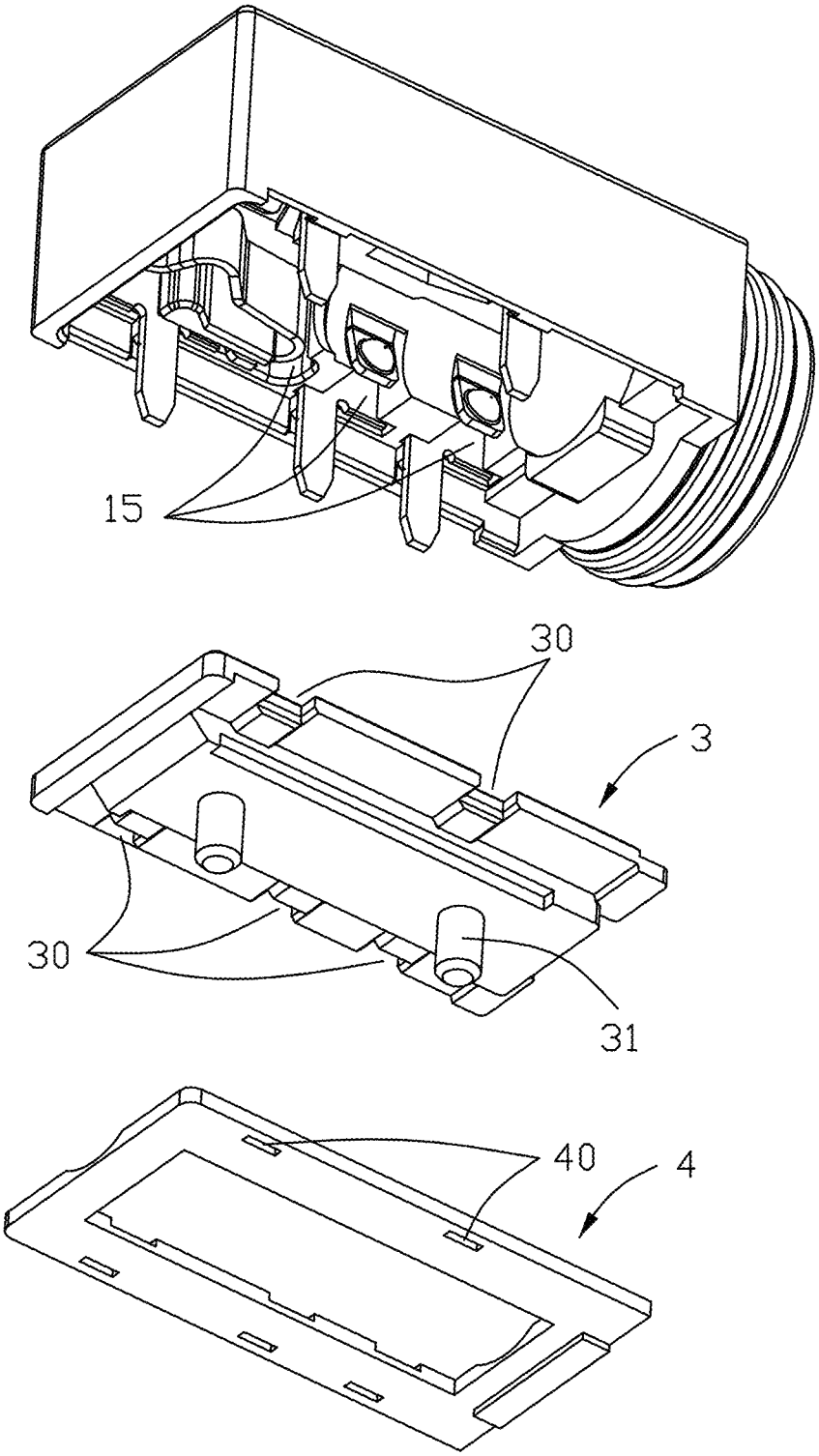
FIG. 3 is an exploded perspective view of the electrical connector of FIG. 1.
Figure 4:
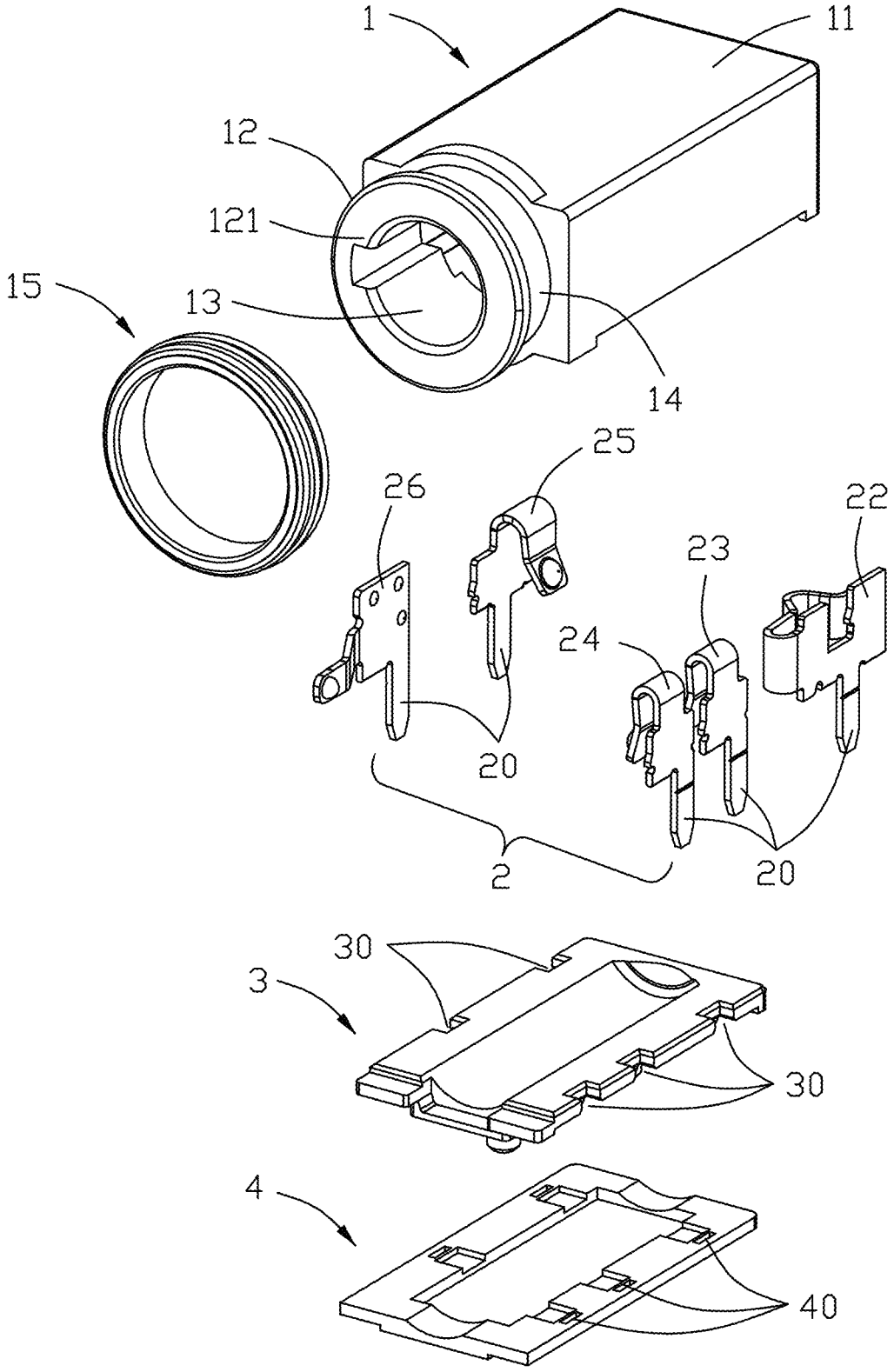
FIG. 4 is a further exploded perspective view of the electrical connector of FIG. 3.
Figure 5:
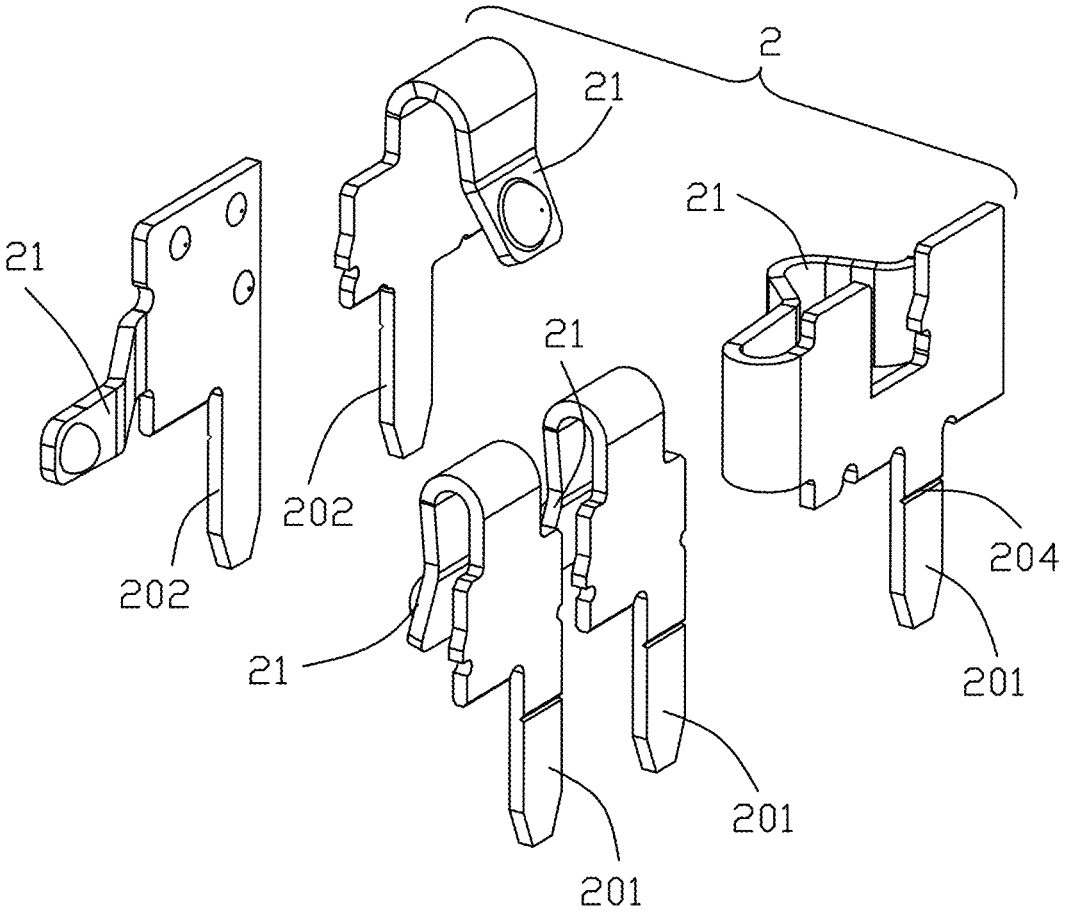
FIG. 5 is an exploded perspective view of the contacts of the electrical connector of FIG. 4.

Referring to FIGS. 1-6, an electrical connector 100 for mounting upon a printed circuit board, includes an insulative housing 1 and a plurality of contacts retained in the housing 1. The housing 1 includes a main body 11 and a mating port 12 extending forwardly from the main body 11. The main body 11 includes a top wall and two side walls with a bottom opening. A plurality of passageway 15 are formed in the main body 11 and communicate to the bottom opening. The mating port 12 forms a front face 121, and a mating cavity 13 forwardly communicating with an exterior through the front face 121 and rearwardly extending into the main body 11. The mating port 12 is cylindrical with a retention groove 14 in an exterior surface. An O-ring 16 is secured within the retention groove 14.

A plurality of contacts 2 are inserted into the corresponding passageways 15, respectively, and includes a left channel contact 22, the right channel contact 23, a grounding contact 24, a detect contact 25 and the microphone contact 26. Each contact 2 includes a contacting section 21 exposed within the mating cavity 13 for mating with the inserted plug, and a soldering leg/section 20 extending outside of the housing 1 for mounting to the printed circuit board. The soldering leg 20 includes two main surfaces 201 and two edge surfaces 202.

A bottom cover 3 is attached to an underside of the main body 11 to cover the bottom opening, and forms a plurality of recesses 30 through which the soldering legs 20 extend downwardly. A pair of positioning posts 31 downwardly extend from the bottom cover 3. Understandably, gaps may occur between the interface between the bottom cover 3 and the main body 11, and among the soldering leg 20, the bottom cover 3 and the main body 11. Therefore, a frame like glue plate 3 is attached upon a bottom side of the housing to seal gaps among the soldering legs 20, the bottom cover 3 and the main body 11. The glue plate forms a plurality of through holes 40 which the soldering legs 20 downwardly extend through.

Figure 6:
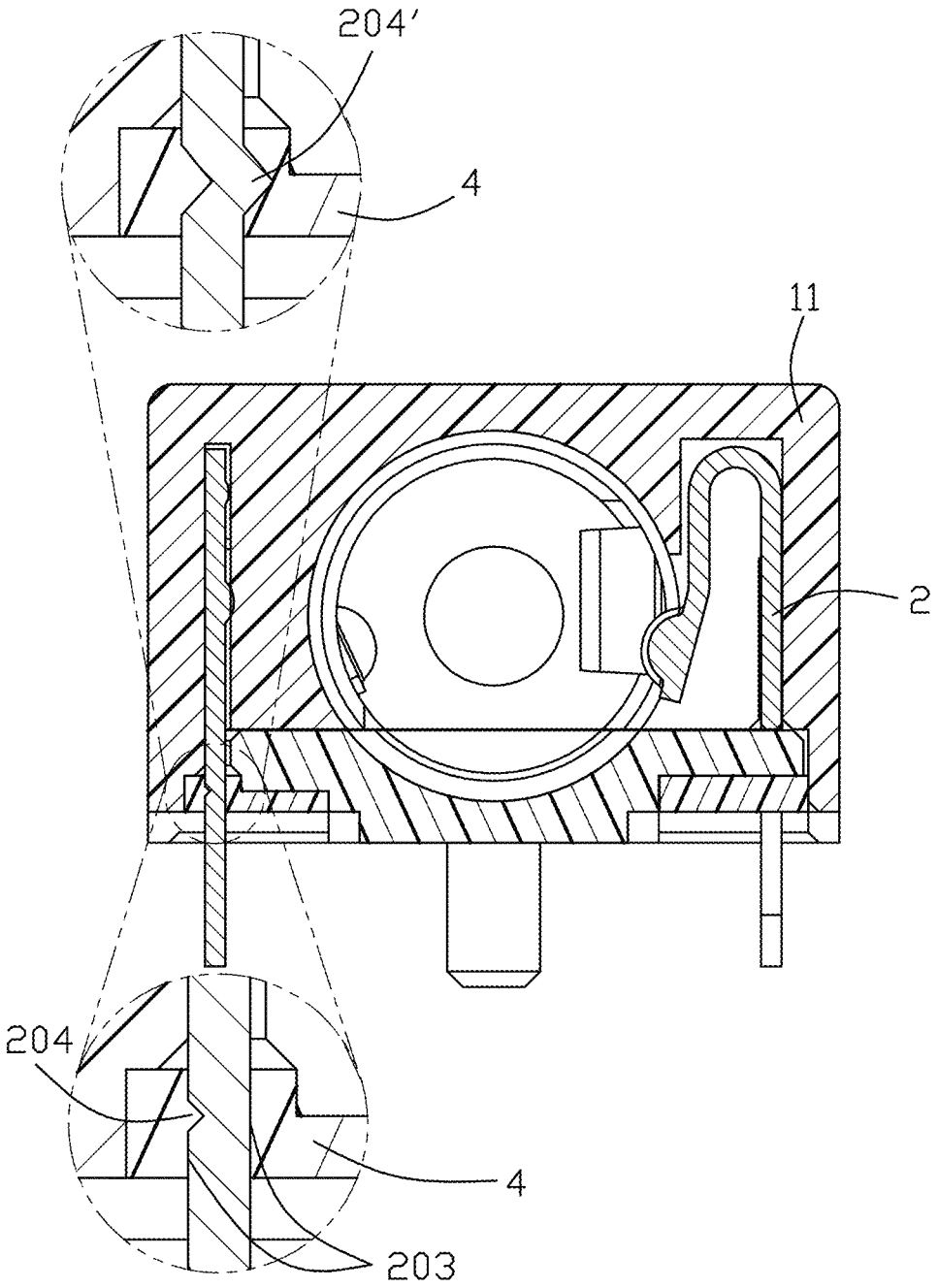
FIG. 6 is a cross-sectional view of the electrical connector of FIG. 1.

The feature of the invention is to have the soldering leg 20 define a confrontation surface 203 with a transverse groove 204 located in the main surface 201 and extending through two opposite edge surfaces 202 so as to efficiently enhance securement between the soldering leg 20 and the glue plate 4. Understandably, the cross-section of the transverse groove 204 may be V-shaped, U-shaped or trapezoidal. The groove 204 may be fully embedded within the glue plate 4. Notably, each though hole 40 is not uniform in the vertical direction due to existence of the transverse groove 204 which is filled with material of the glue plate 4. Alternately, as shown in FIG. 6, in another embodiment, a bump 204' may be optionally formed on the opposite main surface of the soldering leg corresponding to the transverse groove 204 so as to further enhance the securement between the glue plate and the soldering leg. Understandably, both the groove 204 and the bump 204' are mechanisms for enhancing securement between the glue plate and the soldering leg. In addition, in this embodiment the retention mechanism, i.e., the groove or the bump, is formed in the main surface of the soldering leg while such a retention mechanism can also be applied upon the edge surface thereof, e.g., barbs.

Figure 7:
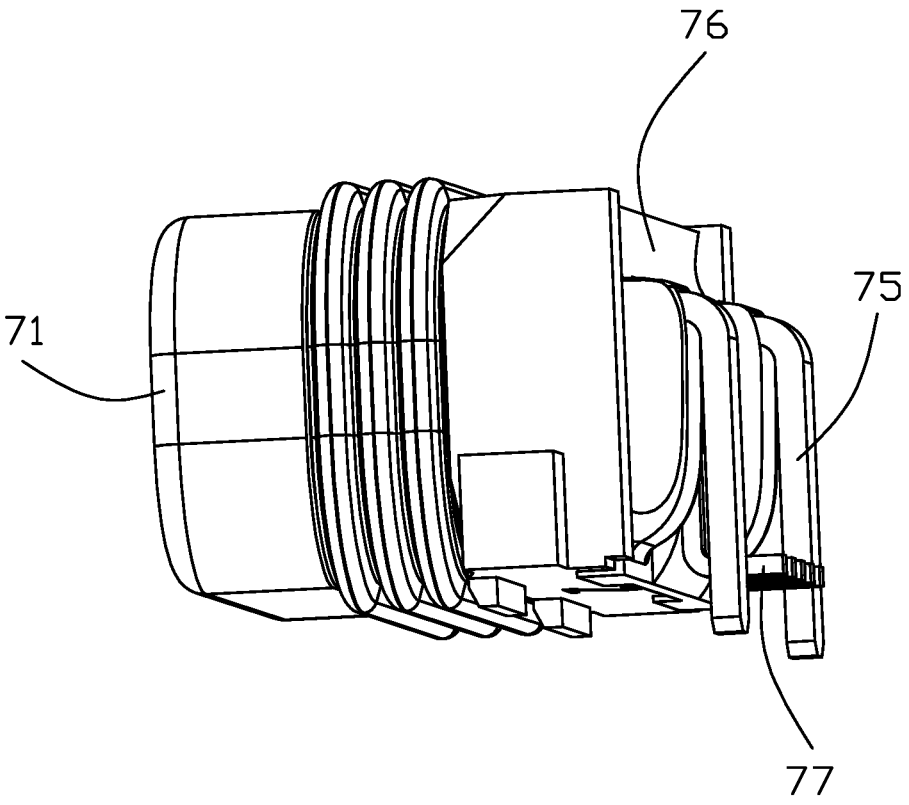
FIG. 7 is a perspective view of the electrical connector according to another embodiment of the invention.
Figure 8:
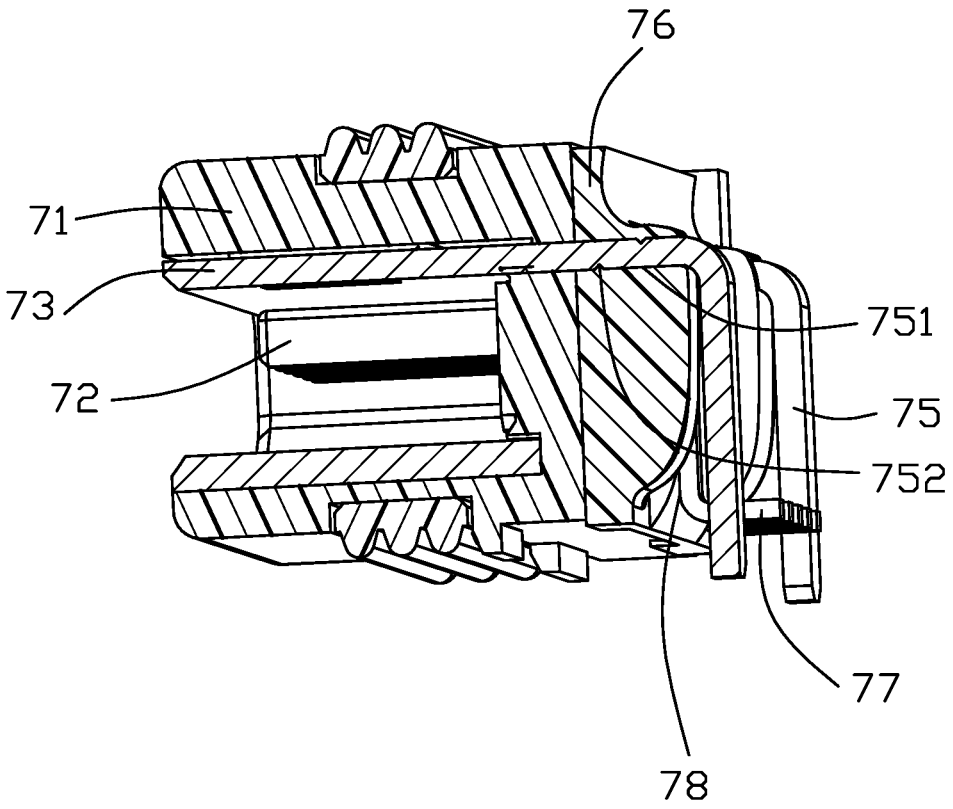
FIG. 8 is a cut-away perspective view of the electrical connector of FIG. 7 to show a cross-section thereof.
Figure 9:
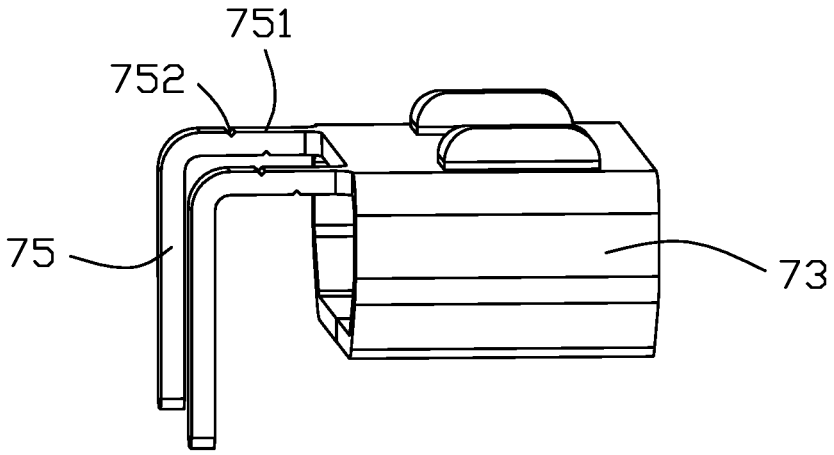
FIG. 9 is a perspective view of the metallic shield of the electrical connector of FIG. 7.

Referring to FIGS. 7-9, the electrical connector may includes an insulative housing 71 with a mating tongue 72, and a metallic shield 73 attached upon the housing 71 with the corresponding mounting legs 75 of the metallic shield 73 extending through the glue plate 76 as well as the soldering legs 77 of the contacts 78. Similarly, the main surface 751 of the mounting legs 75 is equipped with the transverse groove 752 embedded within the glue plate 76. In this embodiment, two transverse grooves 752 are formed in the opposite main surfaces 751 in an offset manner.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

an insulative housing having a main body defining a mating cavity with a plurality of passageways by two sides of the mating cavity, the mating cavity forwardly open to an exterior along a front-to-back direction, and a downward bottom opening formed in an underside of the housing in a vertical direction perpendicular to the front-to-back direction;

a plurality of contacts upwardly inserted into the corresponding passageways along the vertical direction via the bottom opening, each of said contacts having a contact section extending into the mating cavity, and a soldering leg extending downwardly outside of the housing and defining a pair of opposite main surfaces and a pair of opposite edge surfaces;

a bottom cover attached to the underside of the housing to cover the bottom opening; and a glue plate, through which the soldering legs of the contacts downwardly extend, applied upon the bottom side of the housing to seal gaps among the bottom cover, the housing and the soldering legs of the contacts; wherein a transverse groove is formed in the main surface of the soldering leg of each contact and embedded within the glue plate.

2. The electrical connector as claimed in claim 1, wherein the transverse groove is V-shaped.

3. The electrical connector as claimed in claim 1, wherein the bottom cover forms a plurality of recesses to receive the soldering legs of the corresponding contacts, respectively.

4. The electrical connector as claimed in claim 1, wherein the transverse groove extends through the pair of opposite edge surfaces.

5. The electrical connector as claimed in claim 1, wherein the bottom cover is of a frame structure.

6. The electrical connector as claimed in claim 1, wherein the transverse groove is formed in the main surface which faces outwardly.

7. An electrical connector comprising:

an insulative housing;

a metallic shield attached upon the housing and forming a plurality of mounting legs, each of said mounting legs defining a main surface thereof;

a plurality of contacts disposed in the housing and forming a plurality of soldering legs, respectively, each of said soldering legs defining a main surface thereof; and a glue plate, through which both the soldering legs and mounting legs extend, attached upon the housing; wherein either the main surface of the soldering leg or the main surface of the mounting leg includes retention mechanism embedded within the glue plate for enhancing securement between the glue plate and either the corresponding soldering leg or the corresponding mounting leg.

8. The electrical connector as claimed in claim 7, wherein said retention mechanism is either a groove or a bump.

9. The electrical connector as claimed in claim 8, wherein said retention mechanism is either a transverse groove or a transverse bump.

10. The electrical connector as claimed in claim 9, wherein the transverse groove extends through either opposite edge surfaces of the corresponding soldering leg or opposite edge surfaces of the corresponding mounting leg.

11. The electrical connector as claimed in claim 9, wherein the transverse bump extends through either opposite edge surfaces of the corresponding soldering leg or opposite edge surfaces of the corresponding mounting leg.

12. The electrical connector as claimed in claim 7, wherein the glue plate is attached upon a rear side of the housing.

13. An electrical connector comprising:

an insulative housing defining a mating cavity forwardly open to an exterior along a front-to-back direction, and forming a plurality of passageways therein;

a plurality of contacts retained in the corresponding passageways, respectively, each of said contacts including a contacting section extending into the mating cavity, and a soldering leg exposed outside of the housing and defining a surface thereof; and a glue plate, through which the soldering legs of the contacts extend, attached upon one side of the housing; wherein a retention mechanism is formed on the surface in an offset manner and embedded within the glue plate to enhance securement between the soldering leg and the glue plate; wherein said surface is a main surface rather than an edge surface of the soldering leg.

14. The electrical connector as claimed in claim 13, wherein said retention mechanism is at least one of a groove and a bump.

15. The electrical connector as claimed in claim 14, wherein said retention mechanism transversely extends through two opposite edge surfaces of the soldering leg by two sides of the main surface.

16. The electrical connector as claimed in claim 15, further including a bottom cover to cover the mating cavity in a vertical direction.

17. The electrical connector as claimed in claim 16, wherein the glue plate is applied upon the bottom cover.

18. The electrical connector as claimed in claim 17, wherein the glue plate forms a plurality of through holes receiving the soldering legs of corresponding contacts, respectively.

19. The electrical connector a claimed in claim 18, wherein each through hole is not uniform in a vertical direction.

20. The electrical connector as claimed in claim 1, wherein each contact includes a vertical main plate coplanar with the corresponding soldering leg, and barbs are formed on two side edges of the vertical main plate.

* * * * *